United States Patent [19]

Nishimura et al.

[11] Patent Number: 4,677,944

[45] Date of Patent: Jul. 7, 1987

[54] FUEL SUPPLYING DEVICE FOR INTERNAL COMBUSTION ENGINE

[75] Inventors: Seiichi Nishimura; Hidekazu Takayasu, both of Hamamatsu, Japan

[73] Assignee: Sanshin Kogyo Kabushiki Kaisha, Hamamatsu, Japan

[21] Appl. No.: 873,105

[22] Filed: Jun. 9, 1986

[63] This is a continuation of Ser. No. 650,364, Sep. 13, 1984, abandoned.

[30] Foreign Application Priority Data

Sep. 17, 1983 [JP] Japan ..... 58-170615

[51] Int. Cl.[4] ..... F02B 43/00

[52] U.S. Cl. ..... 123/73 B; 123/27 GE; 123/575

[58] Field of Search ..... 123/27 GE, 73 BA, 73 R, 123/65 R, 575, 576, 577, 578, 73 B

[56] References Cited

U.S. PATENT DOCUMENTS

| | | | |
|---|---|---|---|
| 1,035,513 | 8/1912 | Ahlberg | 123/575 |
| 1,753,253 | 4/1930 | Tacchella | 123/575 |
| 2,433,111 | 12/1947 | Gehres | 123/27 GE |
| 2,724,372 | 11/1955 | Schowalter | 123/27 GE |
| 3,783,849 | 1/1974 | Bramfitt | 123/578 |
| 4,091,772 | 5/1978 | Heater et al. | 123/27 GE |
| 4,286,553 | 9/1981 | Baltz et al. | 123/73 PP |
| 4,342,287 | 8/1982 | Concepcion | 123/575 |
| 4,393,848 | 7/1983 | Poehlman | 123/575 |
| 4,461,250 | 7/1984 | Mohr | 123/73 R |
| 4,481,909 | 11/1984 | Takada et al. | 123/575 |
| 4,527,516 | 7/1985 | Foster | 123/575 |

*Primary Examiner*—Charles J. Myhre
*Assistant Examiner*—David A. Okonsky
*Attorney, Agent, or Firm*—Ernest A. Beutler

[57] ABSTRACT

A fuel supplying device for an internal combustion engine and particularly the engine of an outboard motor operating on the two-stroke principle. The engine is provided with a charge forming device and induction system that is supplied with a liquid fuel having a quality lower than gasoline. A source of pressurized gaseous fuel is also provided for selectively supplying a higher quality fuel to the engine under certain running conditions.

8 Claims, 1 Drawing Figure

FUEL SUPPLYING DEVICE FOR INTERNAL COMBUSTION ENGINE

This is a continuation of U.S. patent application Ser. No. 650,364, filed Sept. 13, 1984 and now abandoned.

BACKGROUND OF THE INVENTION

This invention relates to a fuel supplying device for an internal combustion engine and more particularly to an improved device for operating an engine on a low quality fuel.

Because of the diminishing quantity of high quality fuels that are available for operating internal combustion engines, and the increased cost of such high quality fuels, it has been proposed to operate engines on fuels other than gasoline. For example, it has been proposed to operate an engine on fuels having lower quality than gasoline such as alcohol or kerosene. Kerosene is a commonly used fuel in connection with outboard motors. Where such lower quality fuels are used, however, it has been proposed to provide a system for introducing a higher quality fuel to the engine during certain running conditions such as starting, cold running and acceleration. Such "dual fuel engines" have fallen into one of two general categories. With one of these categories, the engine is provided with two separate induction systems, one for each fuel, and the operator can select which system supplies fuel to the engine for primarily all of its running conditions. Another type of system embodies a dual fuel charge forming device wherein the two different fuels are mixed with the air and introduced into the induction system in response to its running requirements. Such dual fuel systems of the types previously proposed have been very complicated and, furthermore, may present problems when running under some conditions. For example, with the type of device that automatically switches from one fuel to the other in response to the running conditions, there is a danger that the fuel transfer is not smooth during transitional conditions and unstable running may result.

It is, therefore, a principal object of this invention to provide an improved induction system and fuel supply system for an engine that permits it to operate with a low quality fuel.

It is a further object of this invention to provide a low quality fuel supply device for an internal combustion engine with a simplified arrangement for introducing a higher quality fuel at the operator's discretion or in response to certain running conditions.

SUMMARY OF THE INVENTION

This invention is adapted to be embodied in a fuel feeding system for an internal combustion engine of the type operated on a liquid fuel and having a charge forming device and associated induction system for running of the engine. In accordance with the invention, a source of pressurized gaseous fuel is provided and means are incorporated for selectively supplying the gaseous fuel to the engine.

BRIEF DESCRIPTION OF THE DRAWINGS

The single FIGURE of the drawings is a side elevational view of the power head of an outboard motor constructed in accordance with the invention, with certain portions broken away and other portions shown in phantom.

DETAILED DESCRIPTION OF THE PREFERRED EMBODIMENTS

Figure 1:
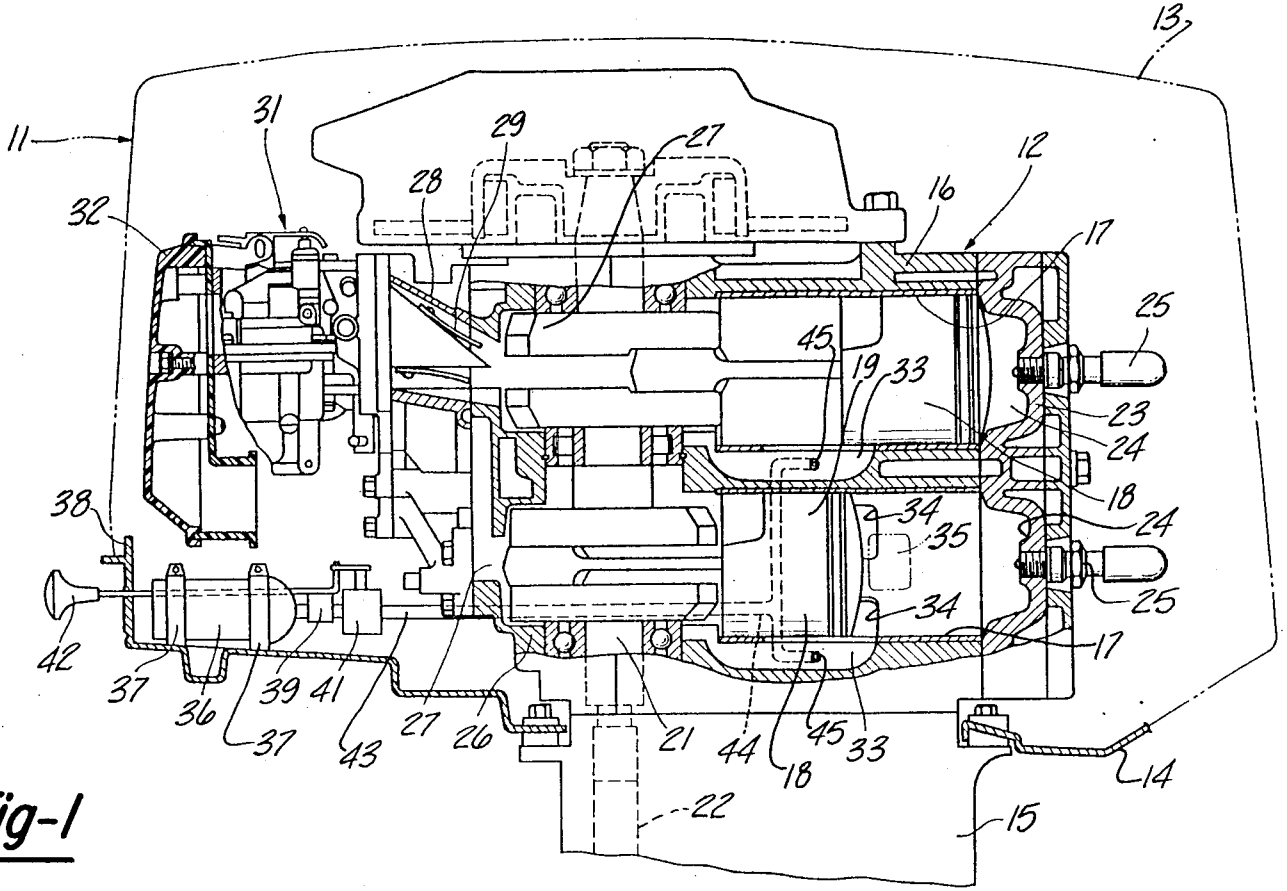

An outboard motor constructed in accordance with an embodiment of the invention is identified generally by the reference numeral 11. The outboard motor 11 includes a power head consisting of an internal combustion engine 12 and a surrounding protective cowling, which is shown only partially and which is identified by the reference numeral 13. This protective cowling 13 includes a lower tray 14 that is affixed to the upper end of a drive shaft housing 15. Only the power head and upper portion of the drive shaft housing have been illustrated inasmuch as the invention relates to the manner for supplying fuel to the engine 12.

The engine 12 includes a cylinder block 16 that is formed with one or more cylinder bores 17. In the illustrated embodiment, the engine 12 is of the two cylinder in-line type and, as is normal in connection with outboard motor practice, the cylinder bores 17 extend in a horizontal direction and are position one above the other. As will become readily apparent to those skilled in the art, however, the invention is adapted for use with engines of other cylinder numbers and types and, in fact, may be used with other than reciprocating engines.

Pistons 18 are supported for reciprocation within the cylinder bores 17 and are connected by means of connecting rods 19 to a crankshaft 21 that is supported for rotation about a vertically extending axis. The crankshaft 21 is rotatably coupled to a drive shaft 22 that extends through the drive shaft housing 15 and drives a propeller mounted in the lower unit (not shown) in a known manner.

A cylinder head 23 is affixed to the cylinder block 16 and is formed with recesses or chambers 24 that cooperate with the pistons 18 and cylinder bores 17 so as to form the combustion chambers of the engine. Spark plugs 25 are supported in the cylinder head 23 and have their terminals exposed in the recesses 24 for firing a charge therein in a known manner.

The crankshaft 21 is journaled for rotation between the cylinder block 16 and a crankcase 26 that is affixed to the cylinder block 16. The engine 12 operates on a two-stroke cycle and, therefore, the crankcase chamber in which the crankshaft 21 is rotatably journaled is divided into separate sealed chambers 27 each associated with a respective one of the cylinder bores 17. A fuel/air mixture is delivered to each of the chambers 27 by means of an intake manifold 28 in which reed type check valves 29 are provided for preventing reverse flow from the chambers 27 back to a carburetor 31. The carburetor 31 is supplied with a liquid fuel in a known manner. In accordance with the invention, the liquid fuel may be a fuel other than gasoline and one which has a lower quality than gasoline, such as kerosene or alcohol. An air inlet device 32 delivers air to the carburetor 31 for forming a charge of fuel/air mixture that is delivered through the manifold 28 and check valves 29 to the respective crankcase chambers 27.

The charge from the chambers 27 is transferred to the combustion chambers 24 through one or more transfer passages 33 that extend through the cylinder block 16 from the crankcase chambers 27 and which terminates at intake or scavenge ports 34 formed in the wall of the cylinder bores 17. As is well known, reciprocation of the pistons 19 causes a charge to be drawn into the respective crankcase chambers 27 and transferred through the transfer or scavenge passages 33 to the combustion chambers 24 through the ports 34. The charge is then fired by the spark plugs 25 and may be exhausted through exhaust ports 35 and a suitable exhaust system (not shown).

Because the engine 12 operates on a low quality liquid fuel, there are some times when the performance may be unsatisfactory. For example, such low quality fuels may offer some difficulties in starting and cold running and further may not provide sufficient energy for the desired acceleration. In accordance with the invention, the engine 12 is provided with a further source of fuel of higher quality such as a pressurized gaseous fuel contained within a high pressure container 36. The container 36 is mounted on the tray 14 of the protective cowling by means of a pair of straps 37 and is juxtaposed to an upstanding front face 38 of the tray. The container 36 is adapted to supply the high pressure gaesous fuel to a pressure regulating valve 39 which reduces the pressure of the gas and maintains it at a predetermined lower pressure. The pressure regulator valve 39, in turn, discharges through a control valve 41. The control valve 41 is adapted to be open and closed by the selective control of the operator through a knob 42 that extends through the front face 38 of the tray in proximity of the operator for easy access.

The gaseous fuel may be delivered to the engine 12 at any point in its induction system. It is particularly advantageous, however, so as to introduce the fuel from the control valve 41 through a conduit 43 that extends to a passage 44 formed in the cylinder block 16 and which terminates at ports 45 that are positioned adjacent to the termination of the transfer passages 33 at the ports 34. Hence, the gaseous fuel will be delivered almost directly to the combustion chambers 24 during the time when the operator selects to operate on the gaseous fuel. This will insure very good performance either under starting, cold running or acceleration.

Preferably, there is a spring biased arrangement operating on the control valve 41 so that when the operator releases the knob 42, the control valve 41 will be immediately closed.

Rather than providing the manual control knob 42, the gaseous fuel flow from the container 36 may be controlled automatically by interconnecting the control valve 41 to the engine starting system or to its acceleration system. Furthermore, rather than placing the container 36 in the protective cowling, it would be possible to place it within the hull of the associated watercraft and thus permit the use of a larger volume container. Also, rather than containing a gaseous fuel, the engine may be supplied with gaseous fuel in the form of the liquid fuel supplied to the carburetor 31 which has been preheated so as to render it into a gaseous state. Various other changes and modifications may be made, without departing from the spirit and scope of the invention, as defined by the appended claims.

We claim:

1. In a fuel feeding system for an outboard motor having an internal combustion engine having a combustion chamber and of the type operated on a liquid fuel and having a charge forming device and associated induction system for running of said engine, and a protective cowling encircling said outboard motor, the improvement comprising a source of pressurized gaseous fuel contained within said protective cowling and means for selectively supplying said gaseous fuel to said engine to an area that communicates with said combustion chamber only during a portion of the cycle of engine operation.

2. In a fuel feeding system as set forth in claim 1 wherein the gaseous fuel is supplied to the engine independently of the charge forming device.

3. In a fuel feeding system as set forth in claim 2 wherein the gaseous fuel is supplied to the engine independently of the induction system.

4. In a fuel feeding system as set forth in claim 1 wherein the engine is of the two-cycle type.

5. In a fuel feeding system as set forth in claim 4 wherein the two-cycle engine is of the crankcase compression type and further including a transfer passage for transferring the compressed fuel/air mixture from the crankcase to the combustion chamber, the gaseous fuel being supplied to the transfer passage.

6. In a fuel feeding system as set forth in claim 1 wherein the source of pressurized gaseous fuel comprises a container containing high pressure gaseous fuel and pressure regulating valve means for supplying the gaseous fuel to the engine at a regulated, lower pressure.

7. In a fuel feeding system for a two-cycle engine of the crankcase compression type operated on a liquid fuel and having a charge forming device and associated induction system for running of said engine, and a transfer passage for transferring the compressed fuel/air mixture from the crankcase to the combustion chamber, the improvement comprising a source of pressurized gaseous fuel and means for selectively supplying said gaseous fuel to said engine through said transfer passage.

8. In a fuel feeding system as set forth in claim 7 wherein the source of pressurized gaseous fuel comprises a container containing high pressure gaseous fuel and pressure regulating valve means for supplying the gaseous fuel to the engine at a regulated, lower pressure.

* * * * *